United States Patent [19]

Vegman et al.

[11] 3,930,642

[45] Jan. 6, 1976

[54] DRUM-TYPE MACHINE FOR AGGLOMERATION OF ORES AND CONCENTRATES UNDER PRESSURE

[76] Inventors: Evgeny Felixovich Vegman, Bryanskaya ulitsa, 28/36, kv. 171; Boris Nikolaevich Zherebin, Teply Stan, mikroraion 3, korpus 32, kv. 116; Sergei Evgenievich Lazutkin, Flotskaya ulitsa, 13, korpus 5, kv. 792; Nikolai Fomich Pashkov, 11 Parkovaya ulitsa, 52, korpus 2, kv. 13; Anatoly Nikolaevich Pyrikov, ulitsa Vinokurova, 9, korpus 1, kv. 25; Anatoly Nikolaevich Pokhvisnev, Valovaya ulitsa 42/44, kv. 31; Julian Semenovich Jusfin, Profsojuznaya ulitsa, 87, korpus 3, kv. 119, all of Moscow; Anatoly Vasilievich Zherdev, ulitsa Zhdanova, 9, Kommunarsk Voroshilovgradskoi oblasti; Valentin Vasilievich Korobov, ulitsa Popova, 55, kv. 77, Kommunarsk Voroshilovgradskoi oblasti; Vitaly Ivanovich Krivonosov, ulitsa Zhukovskogo, 82, Kommunarsk Voroshilovgradskoi oblasti; Ivan Mitrofanovich Mischenko, prospekt Lenina, 12, kv. 30, Kommunarsk Voroshilovgradskoi oblasti, all of U.S.S.R.

[22] Filed: Dec. 30, 1974

[21] Appl. No.: 537,672

[30] Foreign Application Priority Data

Jan. 3, 1974 U.S.S.R. ..... 1984387

[52] U.S. Cl. ..... 266/21; 75/5

[51] Int. Cl.[2] ..... F27B 21/06

[58] Field of Search ..... 75/3, 5; 266/20, 21

[56] References Cited

UNITED STATES PATENTS

| | | | |
|---|---|---|---|
| 916,394 | 3/1909 | Dwight et al. | 266/21 |
| 2,123,593 | 7/1938 | Vogel-Jorgensen | 266/20 X |
| 2,933,306 | 4/1960 | Davis et al. | 266/21 |

*Primary Examiner*—Roy Lake
*Assistant Examiner*—E. F. Desmond
*Attorney, Agent, or Firm*—Waters, Schwartz & Nissen

[57] ABSTRACT

A machine comprises a rotary drum with a sintering grate on the peripheral surface thereof mounted in a tightly sealed casing, and a hearth mounted coaxially with the drum for ignition and sintering of a charge using air and gas supplied to the hearth. The loading of the sintering grate with a bed and charge, as well as the discharge of finished agglomerate are effected through top and bottom seal valves. The drum is mounted on hollow journals which also serve for removing exhaust gases. The peculiarity of the invention is the provision, in the unloading zone of the drum, of a box-shaped housing having the form of a sector in the cross-section which is stationary mounted within the drum coaxially therewith and open on the side facing the sintering grate; and fixed air conduits disposed coaxially within the hollow journals for supplying compressed air into the box of the housing under a pressure substantially exceeding the pressure within the casing.

1 Claim, 2 Drawing Figures

DRUM-TYPE MACHINE FOR AGGLOMERATION OF ORES AND CONCENTRATES UNDER PRESSURE

The present invention relates to the art of agglomeration of iron and mangenese ores and concentrates obtained after enrichment thereof, and more specifically it relates to drum-type machines for agglomeration of ores and concentrates under pressure. The invention may be used at the agglomerating plants in ferrous metallurgy.

Known in the art is a drum-type agglomerating machine for agglomeration of ores and concentrates under pressure (cf. USSR Inventor's Certificate No. 414475, F 27*b* 21/00, Mar. 10, 1972).

In this known agglomerating machine, an agglomeration charge is sintered on a cylindrical sintering grate disposed on the periphery of a rotary drum. Exhaust gases are removed from the sintering grate through internal gas removal chambers rotating together with the drum, each chamber cooperating with a portion of the sintering grate. Waste gases are then discharged through valves incorporated in the gas removal chambers into hollow journals of the drum. The sintering drum is accommodated in a tightly sealed casing, and air is pumped therein by an air-blowing machine. Loading of charge to the drum disposed in the high-pressure zone, and unloading of finished agglomerate from this zone are effected through systems of seal valves. During the rotation of the drum, a charge is continuously loaded to be passed through a zone of ignition and sintering. In this zone, the valves in the gas removal chambers are completely opened to provide for unbstructed flow of exhaust gases into the hollow journals of the machine. After the sintering is completed, in order to discharge finished agglomerate and to prevent compressed air from flowing through the empty sintering grate, the valves in respective chambers of the unloading zone are shut-off.

This known drum-type machine is deficient in a short service life of the valves mounted in the gas removal chambers caused by "avalanches" of charge and dust-laden exhaust gases. In combination with elevated temperature of gases, the action of "avalanches" and dust on the valves results in their failures and frequent unproductive time losses.

In addition, while the valves mounted in the gas removal chambers prevent air from flowing through the sintering grate in the zone of discharge of agglomerate in the course of normal operation, coarse lumps of "avalanche" still can fall on the valve seats. Thus, the valves cannot be closed sufficiently tightly, and air flows through a "cake" of finished agglomerate to penetrate the internal space of the drum so as to urge the "cake" against the sintering grate. Therefore, the urging force is greater than the own weight of the "cake," and the discharge of the agglomerate from the sintering grate will be stopped because a large air leakage in the zone of discharge of agglomerate makes the operation of the machine impossible.

It should be also noted that the system of automatic remote control of the machine valves is also very complicated.

It is an object of the invention to provide a drum-type machine for agglomeration of ores and concentrates under pressure which is simple in manufacture compared to known machines of similar type.

Another object of the invention is to provide a drum-type machine for agglomeration of ores and concentrates under pressure which is more reliable in operation.

The above and other objects are accomplished by the provision of a machine for agglomeration of ores and concentrates under pressure comprising a rotary drum accommodated in a tightly sealed casing communicating, via an air conduit, with a compressed air source and mounted on hollow journals which also serve for removing exhaust gases, the drum having on the peripheral side thereof a sintering grate loaded with a bed and charge through hoppers having seal valves and communicating with the top portion of the casing, the hoppers defining the loading zone of the drum, a hearth for ignition of charge mounted coaxially with the drum and defining therein the zone of ignition and agglomeration of the charge, means for discharging finished agglomerate from the sintering grate, said means being located between the loading zone and the zone of ignition and agglomeration, and a hopper with seal valves for the delivery of finished agglomerate communicating with the bottom portion of the casing, wherein, according to the invention, said means for discharging finished agglomerate from the sintering grate comprises a box-shaped housing having a form of a sector in the cross-section stationary mounted within the drum coaxially therewith and open at the side facing the sintering grate, and fixed air conduits coaxially arranged within the hollow journals for supplying compressed air into the box-shaped housing under a pressure substantially exceeding the pressure in the casing around the drum.

The invention provides a drum-type machine for agglomeration of ores and concentrates under pressure which is characterized by a simple construction and reliable operation. Due the modification of the machine construction, the internal gas removal chambers, valve system and valve control system are completely eliminated.

The invention will now be described in details with reference to a specific embodiment thereof illustrated in the accompanying drawings, in which.

Figure 1:
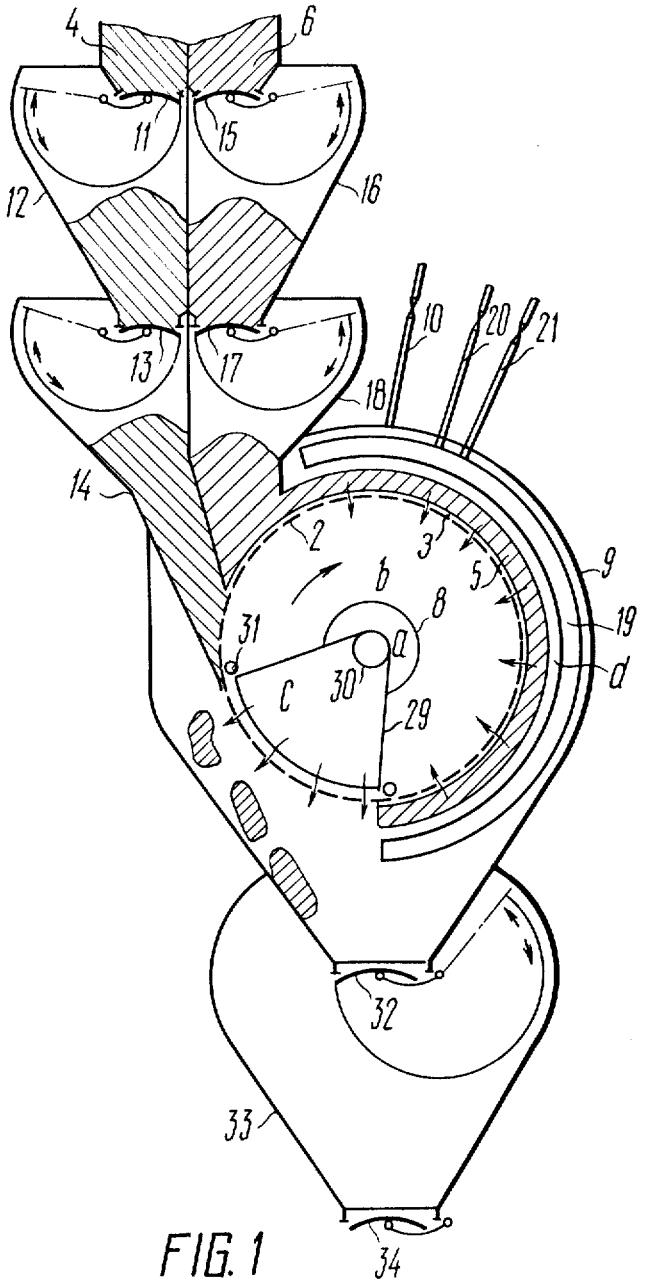
FIG. 1 shows a transverse sectional view of a drum-type machine for agglomeration of ores and concentrates under pressure according to the invention.
Figure 2:
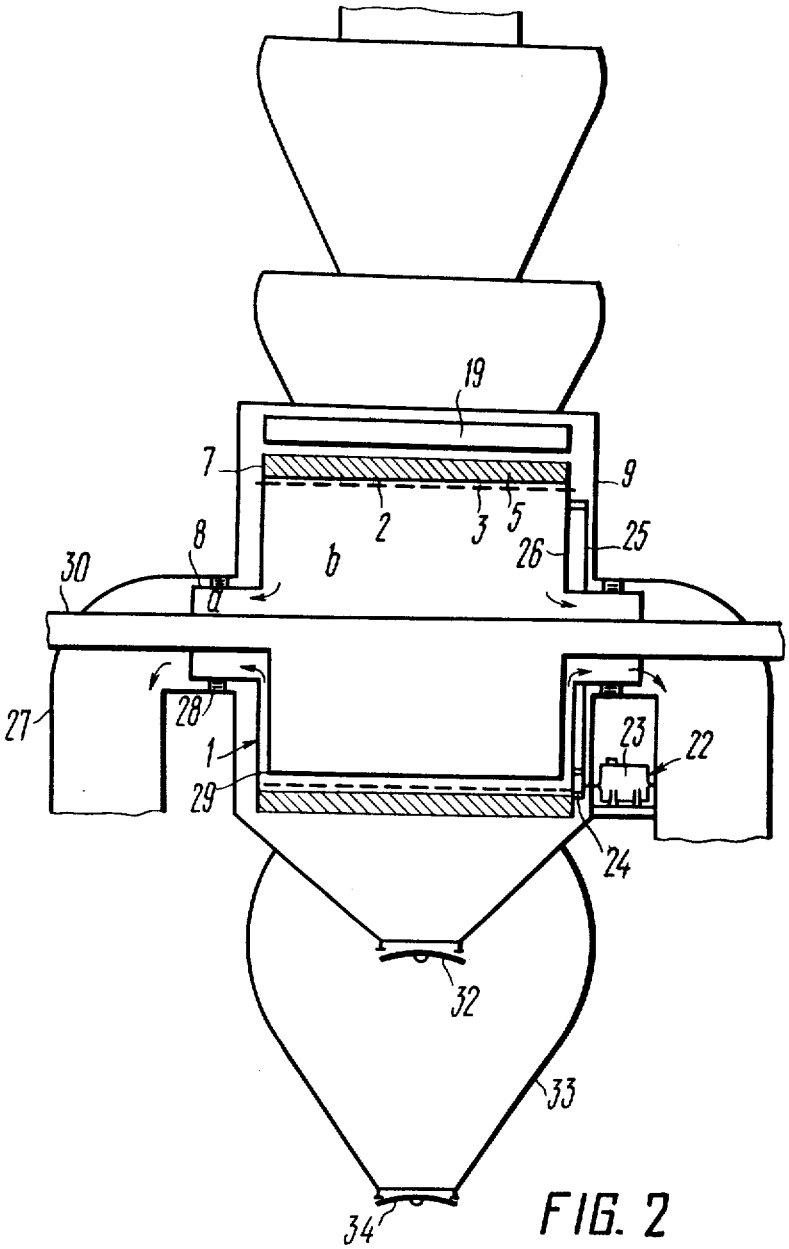
FIG. 2 is a longitudinal section of the machine shown in FIG. 1.

The drum-type machine for agglomeration of ores and concentrates under pressure is shown in FIGS. 1 and 2 comprises a rotary drum 1 having on the cylindrical peripheral surface thereof a sintering grate 2 on which there is placed a layer 3 of a bed 4 in the form of finished agglomerate with a grain size from 5 to 15 mm and a layer 5 of a charge 6 to be sintered. The drum has removable boards 7 of a height corresponding to the total height of the layer 3 of the bed 4 and the layer 5 of the charge 6 being sintered, the height varying from 100 to 1000 mm. The drum is rotated on hollow journals 8 whose internal space *a* also serves for removing gases from the internal space *b* of the drum. The rotational direction of the drum 1 is shown by arrow in FIG. 1.

The machine is enclosed in a tightly sealed casing 9, and air is pumped therein via an air conduit 10 by means of an air-blowing machine (not shown).

The bed 4 is loaded through a seal valve 11 into an intermediate hopper 12, and then, through a seal valve 13 and a hopper 14, the bed is fed onto the cylindrical sintering grate 2 of the drum 1.

The agglomeration charge 6 is loaded through a seal valve 15 into an intermediate hopper 16, and then, through a seal valve 17, it is fed onto the cylindrical sintering grate 2 of the drum 1 over the bed layer.

The direction of movement of each valve 11, 13 and 15, 17 respectively during their opening and closure is shown by arrows in FIG. 1.

The hopper 14 for the bed 4 and the hopper 18 for the charge 6 define the loading zone of the drum 1.

Mounted within the casing 9 on the walls thereof and coaxially with the drum 1 there is an ignition hearth 19 which is supplied with gas and air through conduits 20 and 21. The hearth 19 defines the zone of ignition and agglomeration of the drum 1.

The casing 9 also accommodates a drive 22 of the drum comprising an electric motor 23, a drive gear 24 and a driven gear 25, the latter being fixed to the housing 26 of the drum.

Exhaust gases are removed through gas ducts 27 to scrubbers and then to a chimney stack (not shown).

Packings 28 are mounted between the rotary journals 8 of the drum and stationary gas ducts 27.

The unloading zone of the drum is located between the zone of ignition and sintering and the loading zone. In this zone there is arranged means for discharging finished agglomerate from the sintering grate which comprises a box-shaped housing 29 stationary mounted within the sintering drum 1, coaxial with the drum and having a form of a sector in the cross-section. The housing is open at the side facing the sintering grate 2. The open working surface of the housing 29 is spaced apart 3 – 10 mm from the inner surface of the cylindrical sintering grate 2. The length of the housing corresponds to the length of the generatrix of the drum 1 minus end plays of 5–10 mm. In order to provide for air supply into the internal space *c* of the housing 29, said means has fixed air conduits 30 coaxially arranged within the hollow journals 8. Air from the space *c* is fed towards the sintering grate as indicated by arrows in FIG. 1.

The pressure of air within the internal space *c* of the housing 29 is substantially greater than the air pressure around the drum. The experiments have shown that, with a pressure of up to 5 atm. within the casing, the pressure difference may attain from 0.1 to 1 atm.

The space between the housing 29 and the inner surface of the sintering grate 2 of the drum 1 is sealed by means of four rotary rolls 31.

Finished agglomerate is discharged from the machine casing through a seal valve 32, intermediate hopper 33 and a seal valve 34.

The drum-type machine for agglomeration of ores and concentrates under pressure according to the invention functions as follows.

The entire process of agglomeration of charge is conducted under an elevated pressure within the casing 9 which is obtained by pumping compressed air by means of an air-blowing machine through the air conduit 10.

The charge is sintered on the continuously and uniformly rotating drum 1.

The bed 4 is laid onto the sintering grate 2 of the drum through the seal valves 11, 13, the intermediate hopper 12 and the hopper 14 for the bed.

The charge 6 is laid over the bed 4 through the seal valves 15, 17, the intermediate hopper 16 and the hopper 18 for the charge.

Since the bed and charge are placed onto the sintering grate of the drum in the zone of elevated air pressure, they are urged against the sintering grate 2.

During further rotation of the drum, the charge layer is fed to under the stationary ignition hearth 19, wherein the ignition and subsequent sintering of the charge into agglomerate are effected. It should be noted that gas combustion products and air flow through the layer 5 of the charge 5 being sintered under the pressure difference between the space *d* within the casing 9 and the internal space *b* of the drum (the direction of flow is indicated by arrows in FIG. 1).

Then the finished agglomerate is fed into the unloading zone. In this zone, the air, which is supplied from the air-blowing machine into the box of the housing 29 through the air conduits 30 disposed within the journals 8 under a pressure substantially exceeding the pressure of atmosphere surrounding the drum, is blown through the "cake" of finished agglomerate downwards. In these conditions, not only the own weight of agglomerate, but also the pressure of air from beneath the sintering grate act on agglomerate, and the latter is discharged from the sintering grate.

The open working surface of the housing 29 is spaced apart at 3–10 mm from the inner surface of the sintering grate 2, whereby air losses through the side spaces between the housing 29 and the drum 1 having also sealing rolls 31 can be minimized.

The air supplied beneath the sintering grate in the zone of discharge of agglomerate is then utilized in the sintering zone wherein it is fed under pressure into the layer being sintered. Thus, the total amount of air used in the zone of discharge of agglomerate is subsequently utilized for agglomeration of the charge in the adjacent sections of the machine.

Finished agglomerate is discharged through the seal valves 32, 34 and the intermediate hopper 33.

What is claimed is:

1. A drum-type maching for agglomeration of ores and concentrates under pressure comprising: a drum mounted for rotation; a sintering grate on the peripheral surface of said drum; a tightly sealed casing communicating with a compressed air source, said drum being mounted within said casing; hollow journals mounting said drum and also serving for removing exhaust gases; hoppers with seal valves communicating with the top portion of said casing, said hoppers serving for loading said sintering grate with a bed and charge and defining the loading zone of said drum; a hearth for ignition and sintering of the charge into finished agglomerate mounted within said casing coaxially with said drum and defining the zone of ignition and sintering of the charge; means for discharging finished agglomerate from said sintering grate, said means being disposed between said loading zone and said zone of ignition and sintering, said means defining the unloading zone of said drum; a hopper with seal valves communicating with the bottom portion of said casing and serving for discharging finished agglomerate; said means for discharging finished agglomerate from the sintering grate comprising a box-shaped housing having the form of a sector in the cross-section, said housing being stationary mounted within said drum coaxially therewith and open on the side facing said sintering grate; fixed air conduits disposed coaxially within said hollow journals and serving for supplying into the box of said housing compressed air under a pressure substantially exceeding the pressure in said casing around the drum, whereby finished agglomerate, which is fed during the rotation of said drum into the unloading zone, is discharged from the sintering grate under its own weight and under the action of compressed air supplied from beneath said grate through the box of said housing.

* * * * *